US007258505B2

(12) United States Patent
Dehart

(10) Patent No.: US 7,258,505 B2
(45) Date of Patent: Aug. 21, 2007

(54) VEHICLE BARRIER

(75) Inventor: Jim Dehart, Moyock, NC (US)

(73) Assignee: Blackwater Target Systems LLC, Moyock, NC (US)

( * ) Notice: Subject to any disclaimer, the term of this patent is extended or adjusted under 35 U.S.C. 154(b) by 0 days.

(21) Appl. No.: 11/121,023

(22) Filed: May 4, 2005

(65) Prior Publication Data

US 2005/0201829 A1 Sep. 15, 2005

Related U.S. Application Data

(62) Division of application No. 10/634,760, filed on Aug. 6, 2003, now abandoned.

(60) Provisional application No. 60/401,034, filed on Aug. 6, 2002.

(51) Int. Cl.

| | |
|---|---|
| ***E01F 13/00*** | (2006.01) |
| ***E01F 13/02*** | (2006.01) |
| ***E01F 13/04*** | (2006.01) |
| ***E01F 13/12*** | (2006.01) |
| ***E01F 15/02*** | (2006.01) |
| ***E01F 15/04*** | (2006.01) |
| ***E01F 15/08*** | (2006.01) |
| ***E01F 15/10*** | (2006.01) |
| ***E01F 15/12*** | (2006.01) |

(52) U.S. Cl. ..... 404/6; 404/9; 256/13.1

(58) Field of Classification Search ..... 404/6, 404/9, 10; 256/13.1

See application file for complete search history.

(56) References Cited

U.S. PATENT DOCUMENTS

| | | | | |
|---|---|---|---|---|
| 1,833,124 | A | 11/1931 | Rand | |
| 2,774,323 | A | 12/1956 | Kirk | |
| 4,093,187 | A | 6/1978 | Robinson | |
| 4,542,709 | A | 9/1985 | Spaugh | |
| 5,186,438 | A | 2/1993 | Cross et al. | |
| 5,461,364 | A | 10/1995 | Sanford et al. | |
| 6,200,063 | B1 | 3/2001 | Fritzinger | |
| D445,054 | S * | 7/2001 | Despino et al. | D10/113 |
| 6,517,280 | B2 | 2/2003 | Carter | |
| 6,659,681 | B1 | 12/2003 | Kulp et al. | |

* cited by examiner

*Primary Examiner*—Raymond Addie
(74) *Attorney, Agent, or Firm*—Nixon Peabody LLP; Donald R. Studebaker

(57) ABSTRACT

A portable and scaleable barrier uses a unique combination of feet, interconnecting members and top portions to provide a vehicle barrier that is capable of, for example, lifting the vehicle of the ground and providing substantial undercarriage damage. The interconnecting nature of the barrier allows the barrier to be configured or adapted based on, for example, a particular environmental condition or application.

18 Claims, 6 Drawing Sheets

VEHICLE BARRIER

RELATED APPLICATION DATA

This application claims the benefit of and priority under 35 U.S.C. §119(e) to U.S. patent application Ser. No. 60/401,034, filed Aug. 6, 2002, entitled "The Bear Claw," which is incorporated herein by reference in its entirety. This application is also a Divisional Application of U.S. application Ser. No. 10/634,760, now abandoned, filed Aug. 6, 2003.

BACKGROUND OF THE INVENTION

1. Field of the Invention

This invention relates to barrier devices. In particular, this invention relates to a portable, modular, vehicle barrier.

2. Description of Related Art

Vehicle barriers come in a plurality of different sizes, shapes and materials. For example, the "Jersey Wall" is one of the most common and widely used barrier devices. Typically Jersey Walls are made of preformed concrete and are moved with a forklift or dedicated Jersey Wall mover.

An alternative type of barrier are those seen around military installations and heavily guarded facilities where a hydraulically operated steal plate is embedded in the roadway. To block incoming traffic, the steal plate is raised in a ramp-like configuration to a height suitable for stopping traffic. These types of devices are permanent in nature and are usually installed in a concrete road surface and have an associated control and power facility.

SUMMARY OF THE INVENTION

While existing systems tend to provide a certain level of protection, they are not always portable, scalability can be difficult to achieve and they tend to be more of a permanent type barrier.

An exemplary embodiment of the invention is directed toward a barrier, such as a vehicle barrier. The barrier can be used in, for example, high risk traffic stops, as a barrier around or partially around a protected facility, as a barricade for forward stationed basis, or, for example, by a security team around compounds, facilities and/or homes.

The exemplary barrier, due to its configuration, not only provides incredible vehicle stopping power but also disables vehicles that breach the barrier by, for example, causing significant damage to the undercarriage, motor components and tires.

Aspects of the present invention relate to a barrier. In particular, aspects of the invention relate to a vehicle barrier.

Aspects of the invention further relate to a modular vehicle barrier that is disassembleable.

Aspects of the invention further relate to a vehicle barrier whose components are scalable.

Furthermore, aspects of the present invention relate to a vehicle barrier that engages with a surface to facilitate stopping of an oncoming vehicle.

Additional aspects of the invention also relate to a barrier device adapted to support additional security features such as, for example, barbed wire, constantina wire, spikes, or the like.

These and other features and advantages of this invention are described in, or apparent from, the following detailed description of the embodiments.

BRIEF DESCRIPTION OF THE DRAWINGS

The embodiments of the invention will be described in detailed, with reference to the following figures, wherein.

DETAILED DESCRIPTION OF THE INVENTION

The exemplary systems of this invention will be described in relation to a barrier. However, to avoid unnecessarily obscuring the present invention, the following description omits well-known structures and devices that may be shown in a summarized form. For the purposes of explanation, numerous specific details are set forth in order to provide a thorough understanding of the present invention. It should be however appreciated that the present invention may be practiced in a variety of ways beyond the specific details set forth herein.

For example, while the present invention will be described in relation to a barrier having, in general, a hat-shaped structure, it is to be appreciated that the barrier can be combined with one or more other barriers using an interlocking mechanism as discussed herein to further expand the protection afforded by the unit. Furthermore, it should be appreciated that while the exemplary embodiment is illustrated as having substantially flat plates, other sizes, shapes and combinations of shaped plates could also be used without affecting the operability of the system. Additionally, while the panels are preferable constructed of a steal, such as AR500 or Birnell steal, it should be appreciated that other types of steals, compositions, composites, and combinations of materials can be used. For example, the plates could be a multi-layered material that could include carbon fiber, Kevlar® or the like.

Figure 1:
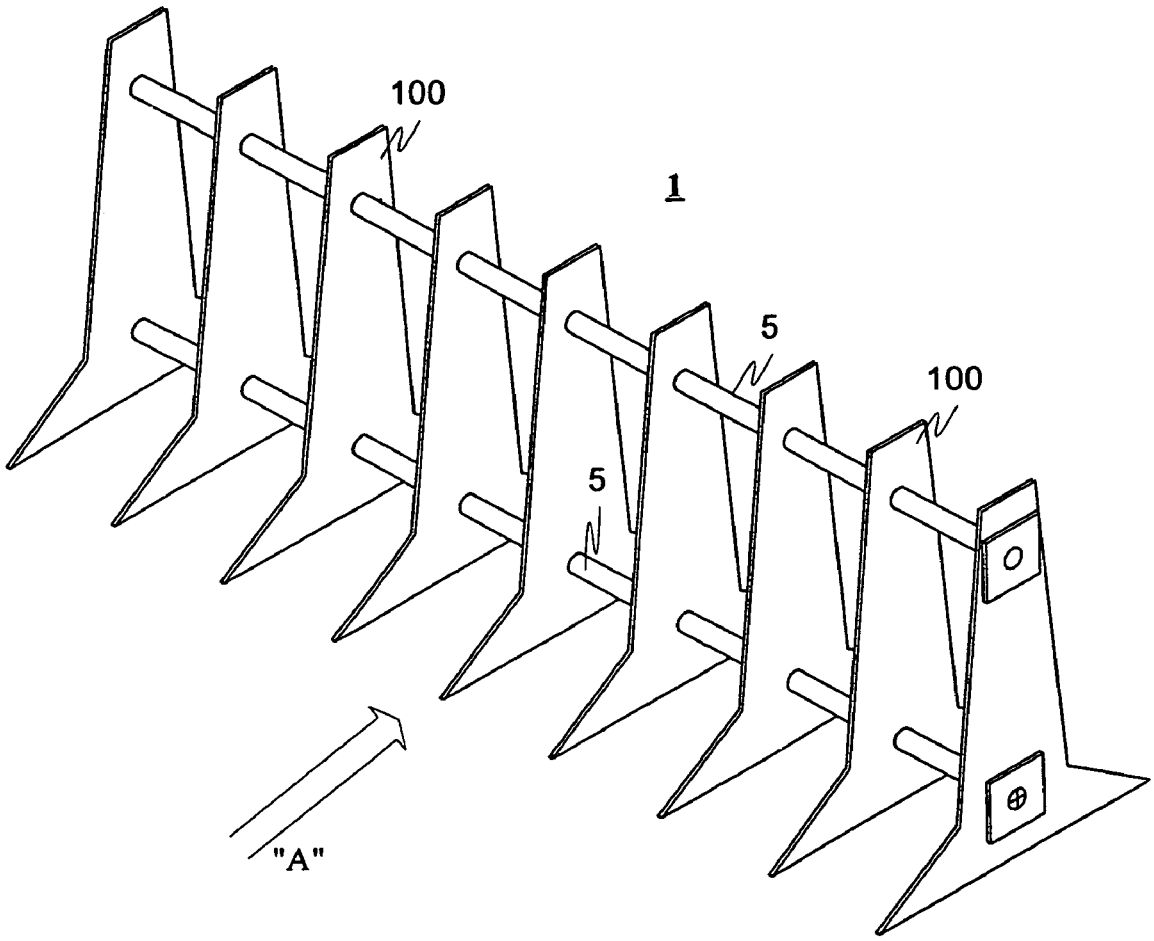
FIG. 1 is a environmental view of an exemplary barrier according to this invention.

FIG. 1 illustrates an exemplary embodiment of the barrier 1. The barrier 1 comprises a plurality of plates 100 interconnected by interconnecting member 5. As can be seen in FIG. 1, and in accordance with this exemplary embodiment, the plates 100 have a witch-hat shaped design that, when combined with one or more other plates 100 provides a self-standing barrier 1.

Thus, in operation, when the barrier 1 is approached by a vehicle generally in direction "A" the barrier is capable of stopping or substantially reducing the speed of the oncoming vehicle by pivoting on the corners opposite the side on which the vehicle engages the barrier.

While the exemplary barrier 1 illustrated in FIG. 1 comprises nine plates 100 and two interconnecting members 5, it should be appreciated that any number of plates and interconnecting members can be used without effecting the operation of the invention. For example, to facilitate portability, the barrier 1 could be provided as a kit comprising four plates 100 and two interconnecting members 5.

Figure 2:
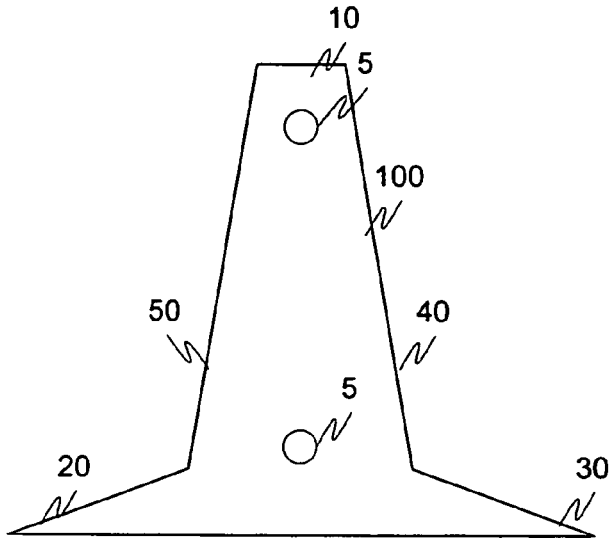
FIG. 2 is a side view of a first exemplary embodiment of a plate according to this invention.

FIG. 2 is a side view of a exemplary plate 100 according to this invention. In particular, the plate 100 comprises a top portion 10, feet 20 and 30, sidewalls 40 and 50 and interconnecting members 5. In accordance with this exemplary embodiment, the plate 100 has an witch-hat shaped configuration where the top portion 10 is substantially parallel to the base comprising the feet 20 and 30. Similarly, the sidewalls 40 and 50 are provided at an orientation that the distance there between is greater where they intersect the feet than where they intersect the top portion 10. While this configuration facilitates uprighting of the plate 100 upon contact by a vehicle, it should be appreciated that the exact dimensions and configuration can be varied in size and shape and the feet adjusted without affecting the operation of the invention. For example, the size and shape of the feet 20 can be varied based on the material the barrier is to be placed on. Specifically, and for example, in an asphalt type environment, it may be advantageous to have the feet 20 and 30 in a pointed type configuration. Alternatively, in a sandy environment, it may be advantageous to have the feet 20 and 30 in a flattened or partially-flattened configuration to aid in supporting the barrier 1 on top of the sand. Likewise, it may be advantageous to have foot 20 in a pointed configuration and foot 30 in flattened configuration or any other combination of feet structures as appropriate for the given conditions.

In accordance with this exemplary embodiment, the plate 100 is attached to adjacent plates via two interconnecting members 5 that are, for example, round and pipe-shaped that interconnect the plurality of plates 100.

Figure 3:
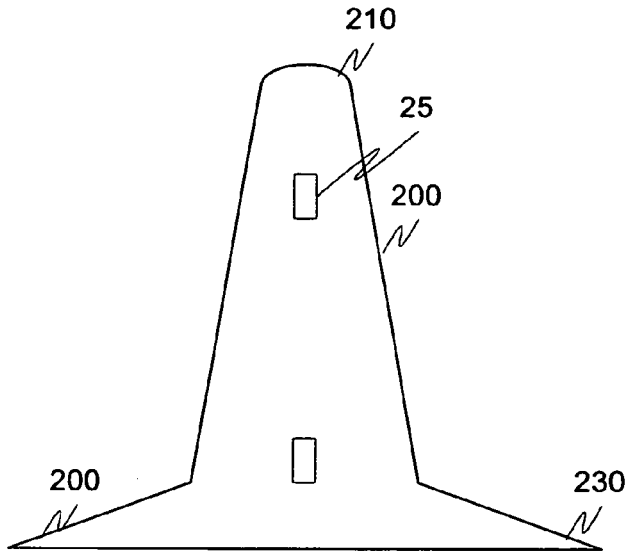
FIG. 3 is a side view of a second exemplary embodiment of a plate according to this invention.

FIG. 3 is a side view of the second exemplary embodiment of a plate 200. The plate 200 comprises a rounded top portion 210, feet 200 and 230, and interconnecting members 25. In this particular exemplary embodiment, the interconnecting members 25 are bar-shaped and can be, for example, tubular or a solid member constructed out of any type of material. The rounded top portion 210 provides a less aggressive top portion that, while still maintaining the functionality of the barrier 1, may be more appropriate around highly populated areas or areas where a large number of personnel may be in close proximity to the barrier 1.

Figure 4:
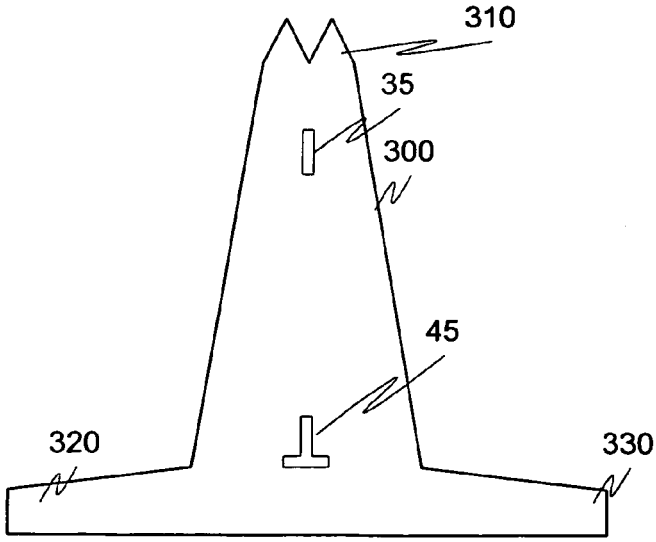
FIG. 4 is a side view of a third exemplary embodiment of a plate according to this invention.

FIG. 4 illustrates a third exemplary plate 300. The exemplary plate 300 comprises a top spiked portion 310, feet 320 and 330, and interconnecting members 35 and 45. In accordance with this exemplary embodiment, the top portion 310 has two or more spike-shaped protrusions that provide a more aggressive barrier 1 and can, for example, provide additional stopping power as the barrier is rotated onto the top portion upon contact by a vehicle. Furthermore, the exemplary plate 300 is interconnected to adjacent plates by a bar 35 and/or T-shaped interconnecting member 45. Additionally, the feet 320 and 330 are configured such that the plate 300 substantially has an inverted T-shaped configuration.

While the exemplary embodiments of the plates 100, 200 and 300 in FIGS. 2, 3 and 4 show various combinations of feet, interconnecting members and top portions, it should be appreciated that these various features can be swapped and interchanged in any combination as appropriate. Also, the top portions and feet can also be different shapes such as semi-hexagonal, semi-octagonal, jagged, or the like. Furthermore, it should be appreciated that the interconnecting members can be in any number, size, shape or configuration, fixed or removable, provided they are capable of supporting a plurality of plates 100 in a substantially upright configuration.

In addition, it should be appreciated that the plates 100, 200 and 300 can be fitted with, for example, reflective tape to facilitate visibility, painted in any color, provided with a facade to help facilitate, for example, blending into a particular environment, or provided with supports to carry additional barrier devices that are commonly seen around compounds, facilities and homes such as barbed wire, razor wire, electric fence, signs, a continuous or pseudo-continuous board above the top portion and substantially parallel to the uppermost interconnecting member, or the like.

Figure 5:
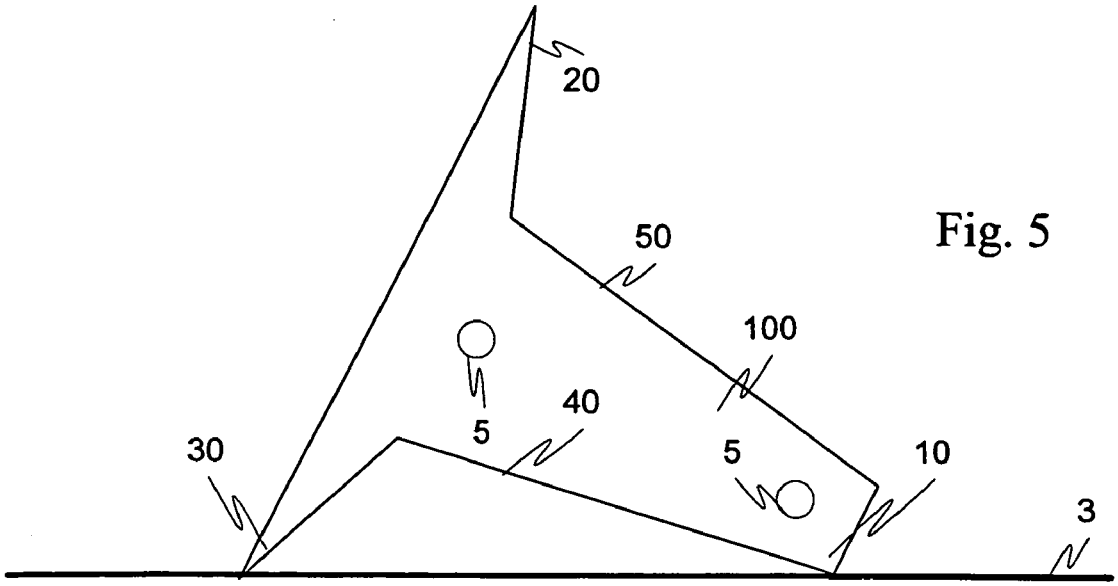
FIG. 5 is a side view of a plate according to this invention.

FIG. 5 illustrates a side view of an exemplary embodiment of the plate 100 in an overturned position after, for example, contact by a vehicle. Thus, in operation, as a vehicle approaches from direction "A" as illustrated in FIG. 1, and comes into contact with the barrier 1, the barrier 1 overturns with foot 30 acting as a fulcrum forcing foot 20 into the undercarriage of the vehicle with the top portion 10 engaging the ground surface 3 to facilitate stopping of the vehicle. Given the symmetric nature of the plate 100, regardless of the direction of impact, the barrier 1 is capable providing the same type of stopping and undercarriage damaging characteristics. In addition to foot 20 causing undercarriage damage to the vehicle, the foot 20 is also capable of lifting the vehicle that struck the barrier 1 off the ground to further facilitate stopping.

Figure 6:
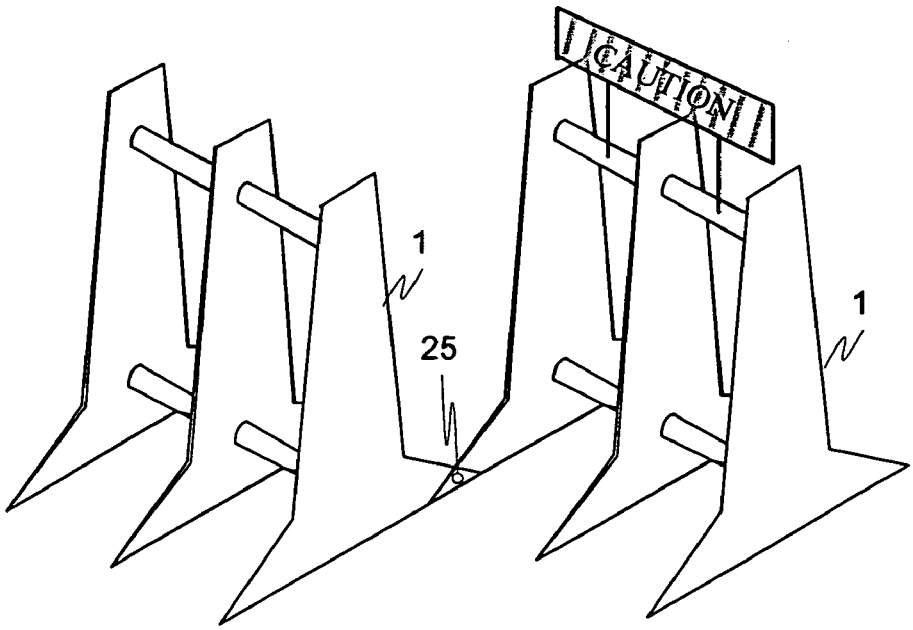
FIG. 6 is a perspective view of an exemplary interconnected barrier system according to this invention.

FIG. 6 illustrates a perspective view of an exemplary configuration of a plurality of interconnected barriers 1. In particular, the barriers 1 are set up in a substantially parallel but offset pattern and interconnected by fastener 25. Using this toe-to-toe configuration, the plurality of barriers can be established in a stair-shaped pattern, a zig-zag pattern, or any other pattern as appropriate. For example, while in the exemplary embodiment in FIG. 6 the two barriers 1 are connected by fastener 25, it should be appreciated that the barriers need not be interconnected by fasteners but could also be placed end-to-end or substantially end-to-end as appropriate.

Figure 7:
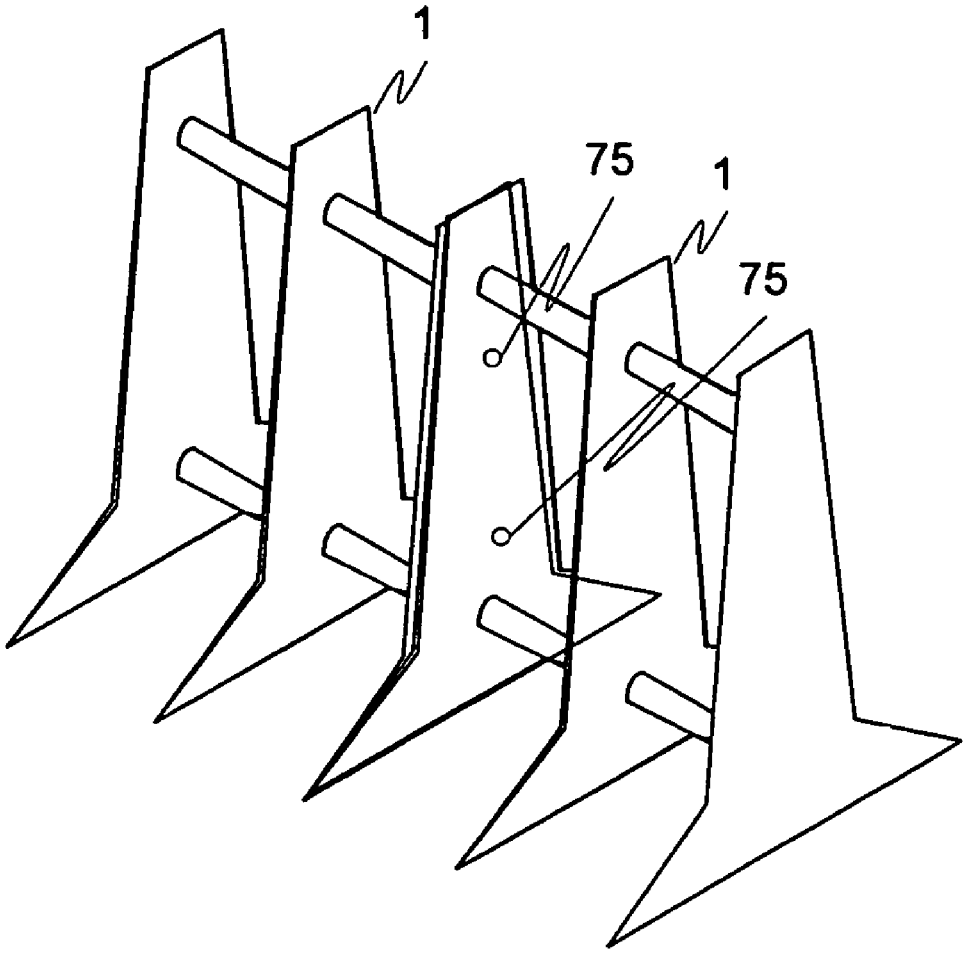
FIG. 7 is a perspective view of a second exemplary embodiment of a barrier system according to this invention.

Specifically, FIG. 7 illustrates an exemplary embodiment where two barriers 1 are interconnected end-to-end with fasteners 75. The fasteners 75, as with the fastener 25, can be any known or later developed fastener such as a nut and bolt, pin and cotter key, or any other known or later developed fastener. Likewise, while the illustrated embodiments in FIGS. 6 and 7 show the particular orientations of the barrier sections in relation to one another, it should be appreciated that the barriers can be arranged in any configuration and interconnected in any matter as appropriate.

Figure 8:
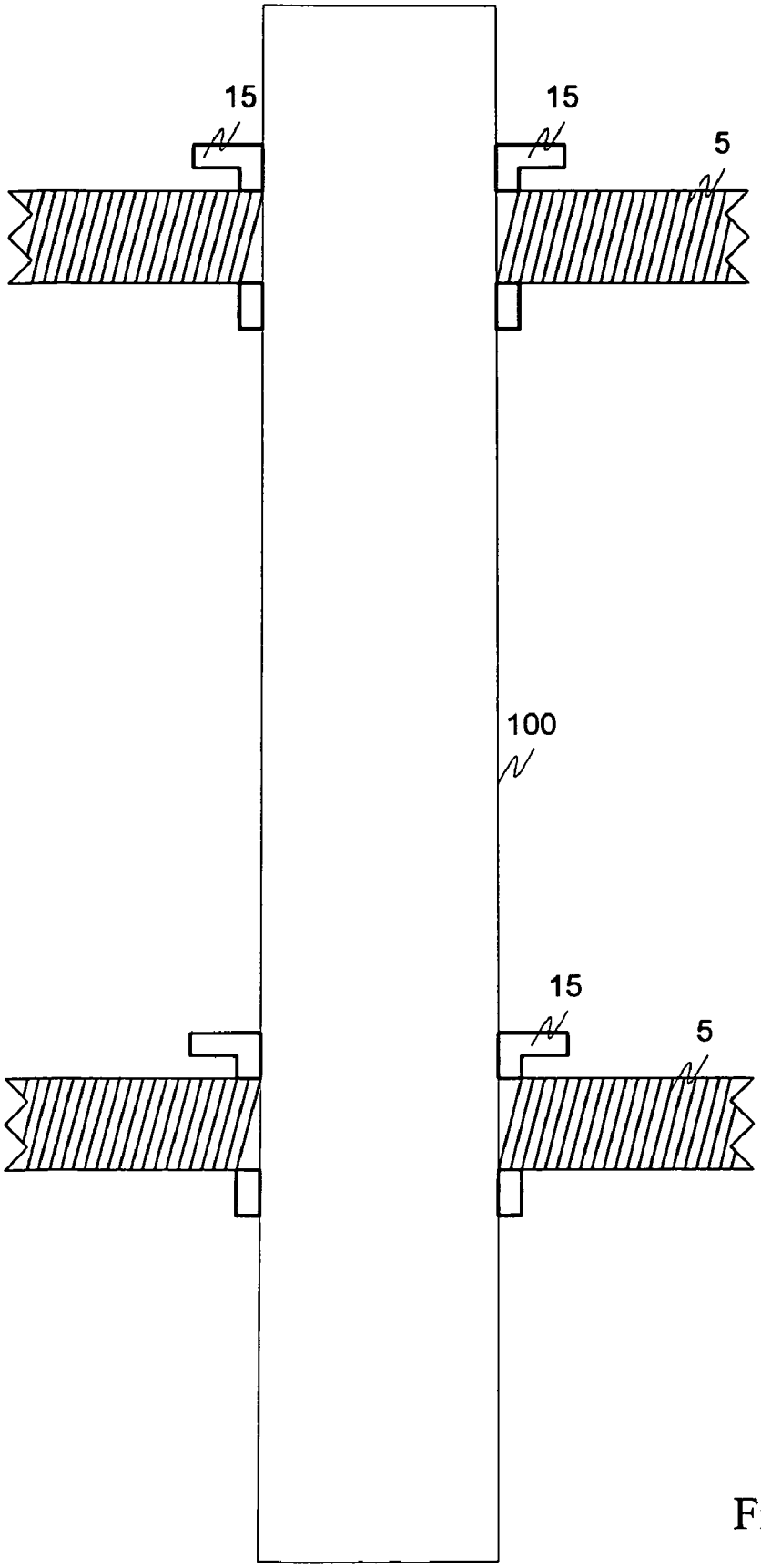
FIG. 8 is a partial cross-sectional view of a plate according to this invention.
Figure 10:
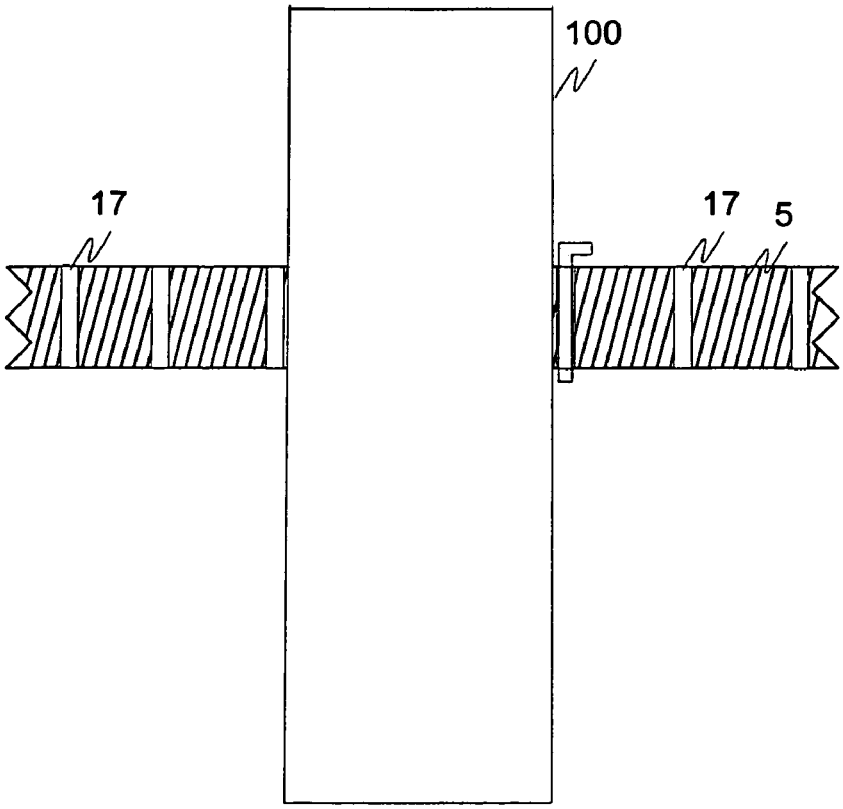
FIG. 10 is a partial cross-sectional view of a plate according to this invention.

FIG. 8 is a partial cross-sectional view of plate 100. In this exemplary embodiment, the interconnecting members 5 pass through the plate 100 and the plate 100 is secured between two fasteners 15. In accordance with this exemplary embodiment, the fasteners 15 are keys however it should be appreciated that any type of fastener can be used in conjunction with the barrier systems and plates discussed herein. Furthermore, while the exemplary embodiment illustrated in FIG. 8 shows the interconnecting members 5 being removable from and slideable through the plate 100, it should be appreciated that the interconnecting members 5 could also be securely fastened to the plate 100 for example, by welding, or the like. In addition, it should be appreciated that the interconnecting members 5 could extend beyond an end plate and be adapted to be interconnect with an adjoining barrier. For example, the interconnecting members could have a male-female relationship where adjoining interconnecting members of the barriers would slide together thereby providing a substantially uniform interconnecting member between the plurality of barriers. In addition, it should be appreciated that the spacing between the plates 100 can be varied for example, by placing a plurality of holes 17 in the interconnecting member 5 as illustrated in FIG. 10. This could provide, for example, additional rigidity by allowing an increased number of plates in the barrier 1 which may be appropriate for a particular application.

Figure 9:
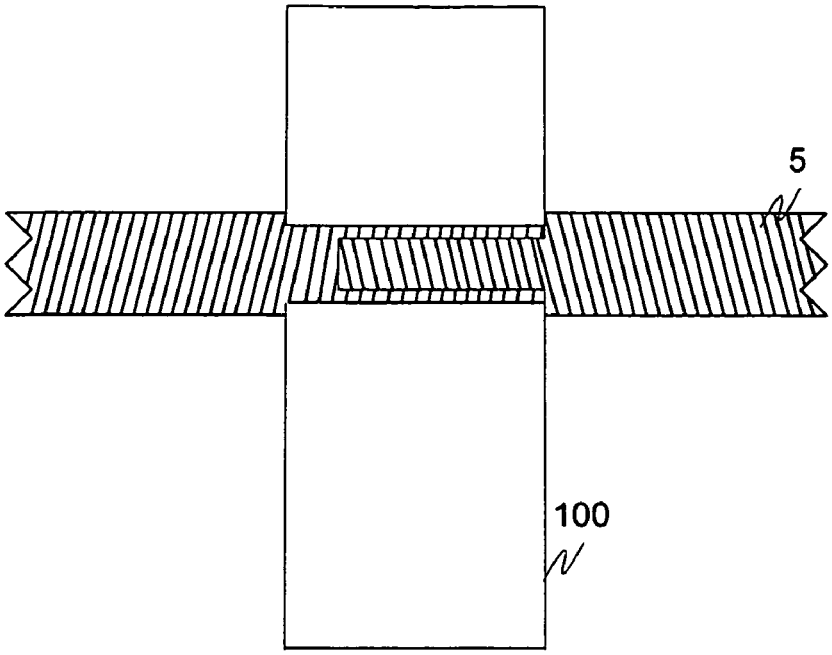
FIG. 9 is a partial cross-sectional view of a plate according to this invention.

FIG. 9 is a partial cross sectional view of a plate 100 in accordance with another exemplary embodiment of this invention. In particular, in this embodiment, the interconnecting member 5 comprises a threaded male portion 21 and a threaded female portion 23. The interconnecting member 5 has a greater diameter than the threaded male portion 21 and the threaded female portion 23 thereby securing the plate 100 there between.

It is, therefore, apparent that there has been provided, in accordance with the present invention, a barrier system. While this invention has been described in conjunction with a number of embodiments, it is evident that many alternatives, modifications, variations would be or are apparent to those of ordinary skill in the applicable arts. Accordingly, the disclosure is intended to embrace all such alternatives, modifications, equivalents and variations that are within the spirit and scope of this invention.

What is claimed is:

1. A vehicle barrier comprising:

a plurality of vehicle immobilizing forms, each form including a substantially upright section having a vehicle contact side and a pivotable side, an extension section extending from said upright section on said vehicle contact side and an opposing pivotable section on the pivotable side positioned on an opposing side of the vehicle contact side of said upright section, said extension having a length which when a vehicle impacts said upright section on the vehicle contact side said extension section extends into an underside of the vehicle while said pivotable section on the pivotable side anchors into a ground surface, by utilizing the weight and the momentum of the vehicle being exerted on the vehicle barrier during an impact, to provide a barrier to immobilize the vehicle; and at least one interconnecting member connecting said plurality of vehicle immobilizing forms and creating a rigid barrier structure, said at least one interconnecting member being positioned between each of said plurality of vehicle immobilizing forms for spacing and supporting each form with respect to an adjacent form;

wherein said interconnecting member is of a length greater than a thickness of each of said forms.

2. The vehicle barrier as defined in claim 1, wherein said forms are of an inverted T-shaped configuration.

3. The vehicle barrier of claim 2, wherein a top portion of said T-shaped form is at least one of rounded, spiked, forked and squared off.

4. The vehicle barrier of claim 1, wherein the interconnecting member is at least one of tubular, T-shaped and a bar.

5. The vehicle barrier of claim 1, wherein said extension section and said pivoting section are any combination of spiked, flat, rounded and forked.

6. The vehicle barrier of claim 1, wherein the barrier is in the form of a barrier section and detachably connectible with one or more additional barrier sections.

7. The vehicle barrier of claim 1, further comprising a securing mechanism adapted to secure at least one of a pedestrian barrier and a sign.

8. The vehicle barrier of claim 1, wherein the at least one interconnecting member is adapted to secure the plurality of forms at a predetermined separating distance.

9. The vehicle barrier of claim 1, wherein said pivotable section has a length that is shorter than said extension section.

10. The vehicle barrier of claim 1, wherein a portion of the pivotable section cooperates with the upright section and the weight and momentum of the vehicle upon impacting the upright section of the vehicle barrier to engage the pivotable section into a ground surface thus anchoring the vehicle barrier into the ground to immobilize the vehicle.

11. The vehicle barrier of claim 1, wherein the pivotable section acts as a fulcrum, the extension section acts as a load when engaged with an underside of the vehicle and the upright section acts as an effort when pushed by the impact of the vehicle, all of which functions as a first class lever to lift the vehicle upon the vehicle barrier being siruck by a vehicle.

12. A vehicle immobilizing form comprising:

a substantially upright section having a vehicle contact side and a pivotable side, an extension section extending from said upright section on the vehicle contact side; and an opposing pivotable section positioned on the pivotable side which is on an opposing side of the vehicle contact side of said upright section, wherein said extension section has a length which cooperates with said pivotable section and said upright section in response to a vehicle contacting said upright section causing said extension section to be cantilevered into an underside of the vehicle, wherein said pivotable section acting as fulcrum, said upright section acting as an effort and utilizing the weight and momentum of the vehicle on the vehicle barrier to immobilize the vehicle.

13. The vehicle immobilizing form as defined in claim 12, wherein said form is of an inverted T-shaped configuration.

14. The vehicle immobilizing form of claim 13, wherein a top portion of said T-shaped form is at least one of rounded, spiked, forked and squared off.

15. The vehicle immobilizing form of claim 12, wherein the vehicle immobilizing form is in the form of a barrier section including a plurality of vehicle immobilizing forms which are adapted to be detachably interconnected with one another.

16. The vehicle immobilizing form of claim 12, wherein said pivotable section has a length that is shorter than the length of said extension section.

17. The vehicle immobilizing form of claim 12, wherein a portion of the pivoting section cooperates with the upright section and the weight and momentum of the vehicle upon impacting the upright section of the vehicle barrier to engage the pivotable section into a ground surface and to anchor the vehicle barrier into the ground to immobilize the vehicle.

18. The vehicle immobilizing form of claim 12, wherein the pivoting section acts as a fulcrum, the extension section acts as a load when engaged with an underside of the vehicle and the upright section acts as an effort when pushed by the impact of the vehicle, all of which functions as a first class lever to lift the vehicle upon the upright section being struck by a vehicle.

* * * * *